US005118006A

United States Patent [19]

Gerhard

[11] Patent Number: 5,118,006

[45] Date of Patent: Jun. 2, 1992

[54] TANK CONTAINER

[75] Inventor: Helmut Gerhard, Weitefeld, Fed. Rep. of Germany

[73] Assignee: Westerwaelder Eisenwerk Gerhard GmbH, Fed. Rep. of Germany

[21] Appl. No.: 750,538

[22] Filed: Aug. 27, 1991

[30] Foreign Application Priority Data

Oct. 10, 1990 [DE] Fed. Rep. of Germany ... 9014104[U]

[51] Int. Cl.[5] ..... B65D 7/42

[52] U.S. Cl. ..... 220/565; 220/592

[58] Field of Search ..... 220/565, 1.5, 592, 4.12, 220/9.1, 668

[56] References Cited

U.S. PATENT DOCUMENTS 2,987,880 6/1961 Kimmel ..... 220/592
3,011,844 12/1961 Maha et al. ..... 220/592
3,730,384 5/1973 Ramme ..... 220/565
3,963,565 6/1976 Being ..... 220/592
4,065,022 12/1977 Cainand ..... 220/565
4,615,453 10/1986 Taquoi ..... 220/565
4,728,000 3/1988 Gerhard ..... 220/565
4,753,363 6/1988 Gerhard ..... 220/565
4,756,447 7/1988 Gerhard ..... 220/565

*Primary Examiner*—Joseph Man-Fu Moy
*Attorney, Agent, or Firm*—Evenson, Wands, Edwards, Lenahan & McKeown

[57] ABSTRACT

A tank container includes a cylindrical tank having its one end connected to an end frame 14 by means of an end saddle structure 12. In the area of its other end, the tank 10 is connected to an end frame 13 by means of a saddle structure 11 in such a manner that the tank bottom 20' provided at this tank end projects through the end frame 13. The saddle structure 11 comprises three rings interconnected partly by welding and partly by screwing, with the innermost ring being welded to the cylindrical portion of the tank envelope.

7 Claims, 2 Drawing Sheets

TANK CONTAINER

BACKGROUND OF THE INVENTION

This invention relates to a tank container with a cylindrical tank which has each of its end regions connected via a three-ring saddle structure to an end frame, which may be provided with corner fittings.

A tank of this type is known from U.S. Pat. No. 4,593,832. With the known container, the tank is coupled to each of the two end frames via a saddle ring connected to the end frame and an end ring which is welded to the tank bottom within the area surrounded by the more strongly curved knuckle zone of the tank bottom. The known saddle-type connection exhibits a number of advantages including a coupling between the tank and the end frames which is insensitive to manufacturing tolerances, yet allows exact overall dimensions of the container to be maintained, with exact spacings between the corner fittings that may be provided on the end frames.

SUMMARY OF THE INVENTION

It is an object of the present invention to modify the known saddle connection in such a manner that, while the above advantages are maintained, it may be employed with swap tanks in which the axial length of the tank exceeds the spacing between the end frames.

This object is met by a tank container including a cylindrical tank having each of its end regions connected via a saddle structure to an end frame which may be provided with corner fittings, at least one saddle structure including a first ring welded to the tank, a second ring having an L-shaped cross-section with a radial flange welded to a surface of the end frame extending perpendicular to the tank axis, and an axial flange extending parallel to the tank axis, and a third ring interposed between the first and second rings, wherein at least one bottom of the tank extends beyond the corresponding end frame in the direction of the tank axis, wherein the first ring includes an axial flange welded to a cylindrical portion of the tank, and an outwardly projecting radial flange, and wherein the third ring includes an axial flange extending parallel to, and welded to, the axial flange of the second ring, and a radial flange extending parallel to, and connected to, the radial flange of the first ring.

By providing a face-to-face abutment between the radial flange of the second ring and the surface of the end frame extending perpendicular to the tank axis, the present invention maintains the possibility of a mutual circumferential alignment between the tank and the end frames during the final assembly, as is also provided in the prior art. Axial tolerances can be compensated by displacing the mutually overlapping axial flanges of the second and third rings.

At the same time, the second and third ring together form a U-profile which permits a certain compensation for variations in length due to temperature changes by virtue of a resilient deformation of the two ring profiles. Such a compensation is of significance when the tank is to contain liquid gas which during operation will cause different changes in length of the tank and the frame.

In a preferred embodiment, the vertical supports of the end frame are formed of U-bars with side legs extending perpendicular to the tank axis. This results in a high-strength end frame with an opening as large as possible which may be penetrated by the tank with its portion of maximum diameter.

Further embodiments of the invention relate to suitable features for minimizing a heat transfer between the tank and the frame.

DETAILED DESCRIPTION OF PREFERRED EMBODIMENTS

Figure 1:
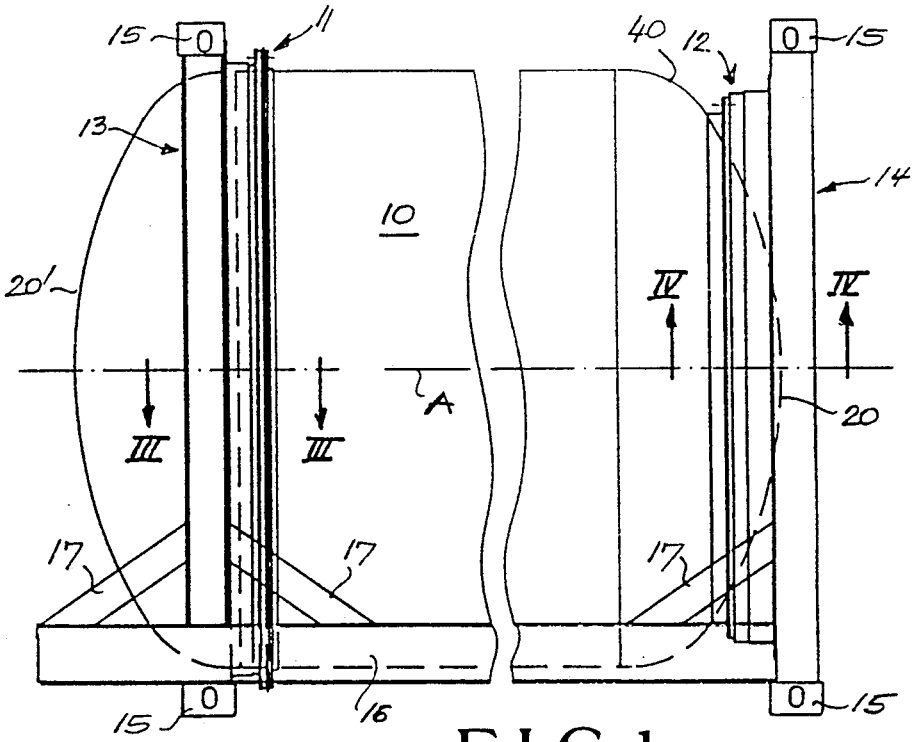
FIG. 1 is a side view of a tank container.
Figure 2:
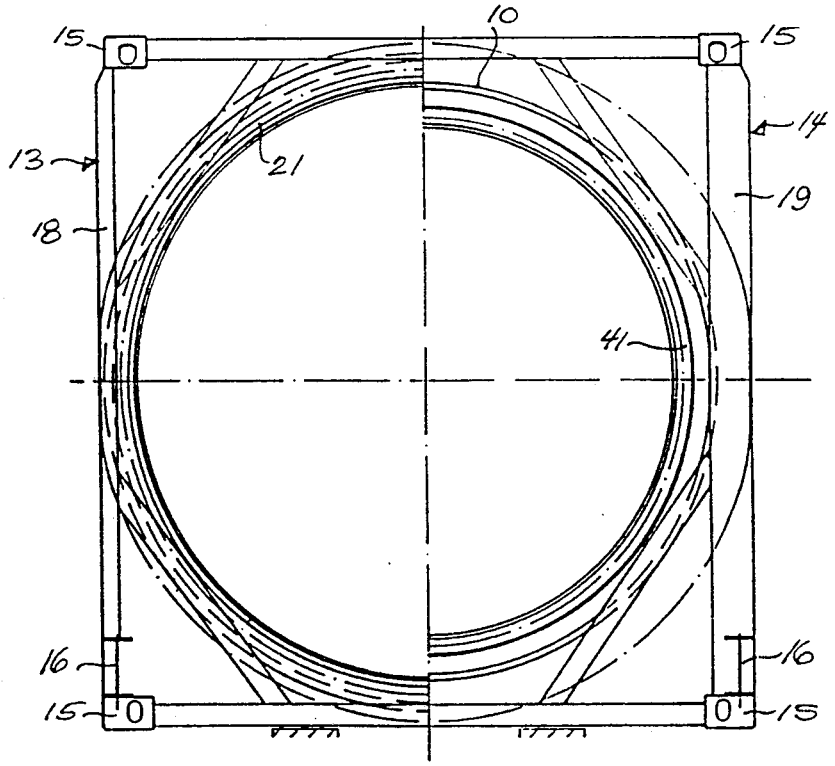
FIG. 2 is an end view of the tank container of FIG. 1, with the left half of FIG. 2 showing the container as viewed from the left in FIG. 1, and the right half showing the container as viewed from the right.

The tank container illustrated in FIGS. 1 and 2 includes a generally cylindrical tank 10 which, in the areas of its two ends, is connected via saddle structures 11, 12 to end frames 13, 14. Each end frame is provided with four corner fittings 15. The lower portions of the two end frames 13, 14 are interconnected by longitudinal bars 16 which are further connected to the end frames 13, 14 by diagonal struts 17.

Figure 3:
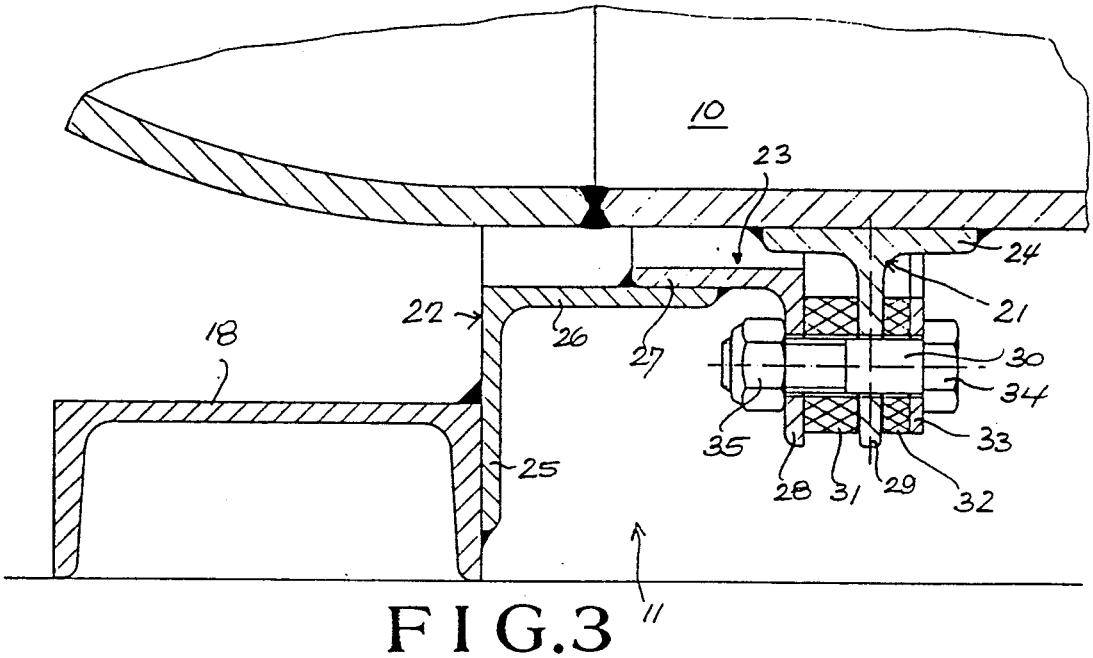
FIGS. 3 and 4 are enlarged cross-sectional partial views of the tank saddle connections, taken along the lines III—III and IV—IV of FIG. 1, respectively.

As shown in the cross-sectional view of FIG. 3, the saddle structure 11 includes a first ring 21, a second ring 22 and a third 23. The first ring 21 has a T-shaped cross-section with its flange 24 extending parallel to the tank axis A (FIG. 1) being welded to the cylindrical portion of the tank envelope. The second ring 22 is formed with an L-shaped cross-section with the radial flange 25 extending perpendicular to the tank axis A being in contact with, and welded to, the surface of the end frame 13 which faces the center of the tank and extends also perpendicular to the tank axis A. As shown in FIG. 3, the vertical supports of the end frame 13 are formed of outwardly open U-bars 18.

The third ring 23 also has an L-shaped cross-section with an axial flange 27 and an outwardly extending radial flange 28. The axial flange 27 extends parallel and inside the axial flange 26 of the second ring 22 and is welded thereto. The radial flange 28 extends parallel to the outwardly extending central web flange 29 of the first ring 21, which has a T-shaped cross-section.

The two parallel flanges 29 and 28 of the first and third rings 21, 23 are interconnected by screw bolts 30 with a heat-insulating spacer 31 inserted between the flanges 28, 29. A further heat-insulating spacer 32 is interposed between the other side of the flange 29 of the first ring 21 and a pressure plate 33 to which the head 34 of the screw bolt 30 may be fastened by spot-welding for securing the bolt against rotation. The counternut 35 may be similarly fastened to the flange 28 of the third ring 23.

The effect of the two spacers 31 and 32 is that a metal contact of good heat-conductivity between the third ring 23 welded to the end frame 13 via the second ring 22 and the first ring 21 welded to the tank 10 can exist only between the screw bolt 30 and part of the interior surface of the bore in the flange 29 penetrated by the bolt 30. The heat-transition surface is thus limited to a minimum.

The spacers 31 and 32 and the pressure plate 33 may be formed separately for each screw bolt 30 or may be shaped as ring segments and thus provided in common for two or more screw bolts 30 disposed next to each other int he circumferential direction.

When the tank 10 is employed for instance for the transport of liquid gas, it is subjected to considerable temperature differences which cause corresponding dimensional changes. A variation in the axial length can be taken up by a resilient deformation of the two L-rings 22 and 23 which are interconnected to form a U-profile.

Figure 4:
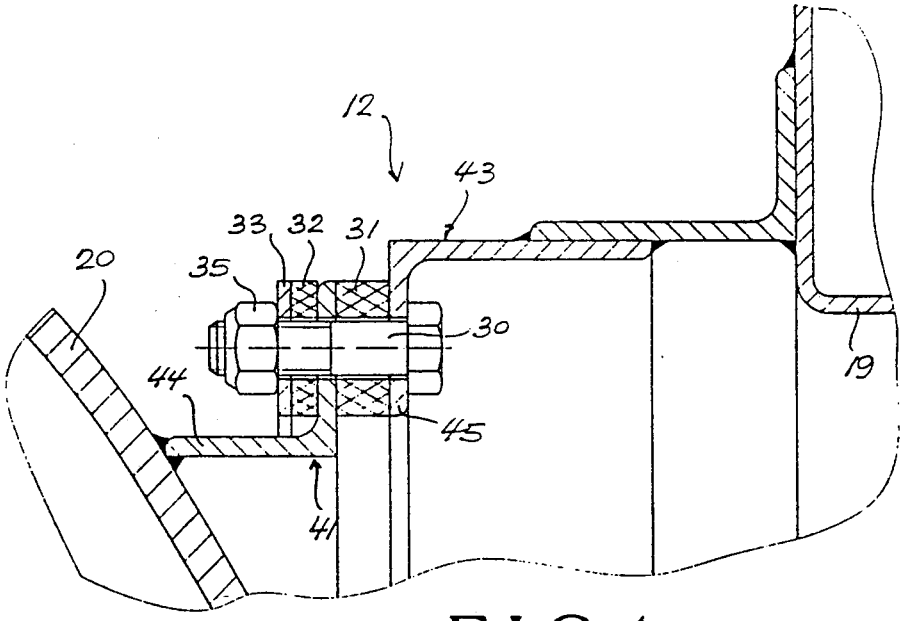

The saddle structure 12, which is shown in detail in the cross-sectional view of FIG. 4 and which is provided at the right-hand end of the tank shown in FIG. 1, is largely identical to the saddle structure 11 of FIG. 3. A difference resides in the fact that the first ring 41 welded to the tank 10 is formed with an L-shaped cross-section, the axial flange 44 of which is welded to the central portion of the tank bottom 20 surrounded by the more strongly curved knuckle zone 40.

Therefore, the first ring 41 of the saddle structure 12 shown in FIG. 4 has a smaller diameter than the first ring 21 of the saddle structure 11 shown in FIG. 3. There is thus a larger difference with respect to the dimension of the end frame 14 the vertical supports of which are formed by L-bars 19 shown in FIG. 4. This dimensional difference is compensated by the third ring 43 having an outwardly extending radial flange 45.

The connection between the tank 10 at its right-hand bottom 20 shown in FIG. 1 and the end frame 14 corresponds to the saddle structure known from U.S. Pat. No. 4,593,832 as far as the mounting of the first ring 41 on the tank bottom 20 is concerned. In the present case, the outermost point of the curved tank bottom 20 is disposed inside the outer plane formed by the end frame 14. At the left-hand end shown in FIG. 1, however, the tank 10 has its curved bottom 20' extending through the end frame 13 and projecting therefrom to the left. There, the outermost limit is formed by the longitudinal bars 16 which are extended to the left beyond the end frame 13 to provide a protection for the tank bottom 20'.

The present concept is thus particularly suited for swap tanks in which the tank length exceeds the spacing between the corner fittings 15 provided on the end frames 13, 14, which spacing may be in accordance with ISO standards.

What is claimed is:

1. A tank container including a cylindrical tank defining a tank axis and having each of its end regions connected via a saddle structure to an end frame, wherein at least one bottom of said tank extends beyond the corresponding end frame in the direction of the tank axis, the saddle structure connecting said at least one tank bottom to the respective end frame including a first ring including an axial flange welded to a cylindrical portion of said tank, and an outwardly projecting radial flange, a second ring having an L-shaped cross-section with a radial flange welded to a surface of said end frame extending perpendicular to the tank axis, and an axial flange extending parallel to the tank axis, and a third ring including an axial flange extending parallel to, and welded to, the axial flange of said second ring, and a radial flange extending parallel to, and connected to, the radial flange of said first ring.

2. The tank container of claim 1, wherein said end frame has vertical supports formed of U-bars with lateral legs extending perpendicular to the tank axis.

3. The tank container of claim 1, wherein the radial flanges of said first and third rings are interconnected by screw bolts.

4. The tank container of claim 3, wherein a first heat-insulating spacer is inserted between the radial flanges of said first and third rings.

5. The tank container of claim 4, wherein a second heat-insulating spacer is inserted between the surface of the radial flange of said first ring facing away from said first spacer, and a pressure plate which provides an abutment for heads of said screw bolts.

6. The tank container of claim 5, wherein said pressure plate is formed as a ring sigment common to a plurality of said screw bolts.

7. The tank container of claim 1, wherein said end frames are provided with corner fittings.

* * * * *